US006120853A

United States Patent [19]

Naruse et al.

[11] Patent Number: 6,120,853

[45] Date of Patent: Sep. 19, 2000

[54] SLIDE BEAD COATING METHOD AND APPARATUS

[75] Inventors: Yasuhito Naruse; Kiyoshi Kamitani; Satoru Matsumoto, all of Shizuoka, Japan

[73] Assignee: Fuji Photo Film Co., Ltd., Kanagawa, Japan

[21] Appl. No.: 09/317,215

[22] Filed: May 24, 1999

Related U.S. Application Data

[63] Continuation of application No. 08/960,057, Oct. 29, 1997, Pat. No. 6,013,327.

[30] Foreign Application Priority Data

Oct. 30, 1996 [JP] Japan ..... 8-288656
Dec. 6, 1996 [JP] Japan ..... 8-327248

[51] Int. Cl.[7] ..... B05D 1/30

[52] U.S. Cl. ..... 427/420; 118/DIG. 2; 118/325; 118/410

[58] Field of Search ..... 118/DIG. 2, 325, 118/410; 427/420, 402, 434.2

[56] References Cited

U.S. PATENT DOCUMENTS 2,761,791 9/1956 Russel .
3,902,862 9/1975 Damschroder et al. .
3,968,722 7/1976 Greiller .
4,297,396 10/1981 Takehara et al. .
5,198,030 3/1993 Franke .

FOREIGN PATENT DOCUMENTS 57-110364 7/1982 Japan .

*Primary Examiner*—Brenda A. Lamb
*Attorney, Agent, or Firm*—Sughrue, Mion, Zinn Macpeak & Seas, PLLC

[57] ABSTRACT

A slide bead coating method and apparatus which is able to form a stable bead over the width of coating solutions and regularly coat the coating solutions on a web to an edge region and which is able to change the width of the coating solutions without stopping the coating operation even if the width of the web changes.

A discharged liquid from a nozzle is applied on both side edges of the coating solutions flowing down a slide surface. Thereby, the stable bead can be formed at the side edges of the coating solutions, so that the coating solutions can be coated on the web to the edge region. Edge bead is formed at both side edges of the coating solutions through the nozzle, so that the width of the coating solutions can be adjusted.

9 Claims, 18 Drawing Sheets

SLIDE BEAD COATING METHOD AND APPARATUS

This is a continuation of application Ser. No. 08/960,057 filed Oct. 29, 1997, now U.S. Pat. No. 6,013,327, the disclosure of which is incorporated herein by reference.

BACKGROUND OF THE INVENTION

1. Field of the Invention

The present invention relates generally to a slide bead coating method and apparatus, and more particularly to a slide bead coating method and apparatus for coating a liquid coating composition on a flexible support (hereinafter referred to as "a web") in order to manufacture photographic film, photographic print paper, a magnetic recording tape, an adhesive tape, pressure sensitive paper, an offset plate, a sheet battery, etc.

2. Description of Related Art

A slide bead coating method has been proposed to apply the coating solution on the surface of the continuously-traveling web.

U.S. Pat. No. 2,761,791 teaches a multiple layer slide bead coating apparatus. In this apparatus, multiple coating solutions, which flow down a slide surface of a coating hopper, form a bead at a position where the coating solutions meet the continuously-traveling web at the front end of the slide surface. The coating solutions are applied on the surface of the web by the bead. Thus, it is important for the above-mentioned coating apparatus to form a stable bead.

The above-mentioned coating apparatus must accommodate webs which have a variety of widths, and the width of the coating solutions flowing down the slide surface must be adjusted according to the width of the web.

In an example of the method for adjusting the width of the coating solution, a guide plate is used which is disclosed in Japanese Patent Provisional Publication No. 57-110364. In this method, a pair of guide plates are provided from the rear end to the front end of the slide surface at both side edges in the direction of the width of the slide surface in order to adjust the width of the coating solution.

In the conventional slide bead coating apparatus using the guide plates, however, the bead formation is unstable at both side edges in the direction of the width of the coating solutions. For this reason, the coating solutions may not be coated on the edge region of the web. Since the edge region must be cut and removed in the after process, an additional step of cutting the edge region must be executed and the yield is lowered.

The coating sequence must be stopped to adjust a distance between the guide plates every time the width of the web changes. Thus, the working efficiency is sometimes lowered drastically due to a loss of time resulting from the stopping of the operation.

SUMMARY OF THE INVENTION

The present invention has been developed in view of the above-described circumstances, and has as its object the provision of a slide bead coating method and apparatus which is able to form a stable bead in the direction of the width of the coating solutions and regularly apply the coating solutions on the web to the edge region, and which is able to change the width of the coating solutions without stopping the coating operation even if the width of the web changes.

To achieve the above-mentioned object, a slide bead coating method of the present invention, in which a liquid coating composition flowing down a slide surface of a coating hopper forms a bead between a lip of the slide surface and a moving web and the liquid coating composition is applied to the surface of the web by the bead, is characterized in that: thick edge bead is formed at both side edges of the liquid coating composition flowing down the slide surface.

According to the present invention, if the rod member is inserted and supported in the liquid coating composition flowing down the slide surface, the flow of the edge bead can be formed on a straight line between the rod member and the front end of the slide surface (the lip). In the flow of edge bead, the longitudinal section of the edge bead rises in a curved form. Since the flow of edge bead is formed at the side edge of the liquid coating composition so that the stable bead can be formed at the side end of the liquid coating composition, the coating solutions can be coated on the edge region of the web. The coating solutions can be regularly coated on the web to the edge region.

Since the rod member is arranged to substantially correspond to the edge line of the web, the liquid coating composition flows at the outside of the rod member and falls from the lip of the slide surface without being applied on the surface on the web. Thereby, the width of the liquid coating composition can be adjusted. In this case, if the width of the web changes, the rod member in the flowing liquid composition changes in a manner to substantially correspond to the edge line of the web which is to be coated next. The width of the coating solutions can be adjusted without stopping the coating operation.

To achieve the above-mentioned object, a slide bead coating method of the present invention in which a liquid coating composition flowing down a slide surface of a coating hopper forms a bead between a lip of the slide surface and a moving web and the liquid coating composition is applied to the surface of the web by the bead, is characterized in that: edge bead is formed by applying the liquid coating composition or a component of the liquid coating composition at both side edges of the liquid coating composition flowing down the slide surface.

Moreover, to achieve the above-mentioned object, a slide bead coating method in which a liquid coating composition flowing down a slide surface of a coating hopper forms a bead between a lip of the slide surface and a web and the liquid coating composition is applied to the surface of the web by the bead, comprises the steps of: forming edge bead at both side edges of the liquid coating solutions flowing down the slide surface by injecting the liquid coating composition or a component of the liquid coating composition into the liquid coating composition at both side edges.

Furthermore, to achieve the above-mentioned object, a slide bead coating apparatus, in which a liquid coating composition flowing down a slide surface of a coating hopper forms a bead between a lip of the slide surface and a web and the liquid coating composition is applied to the surface of the web by the bead, comprises: application means provided at side edges of the liquid coating composition flowing down the slide surface, the application means applying the liquid coating composition or a component of the liquid coating composition on a liquid surface at the side edges.

According to the present invention, the apply means or inject means provided at the side edges of the liquid coating composition flowing down the slide surface applies or injects the liquid coating composition or a component at the side edges. Thereby, the flow of edge bead is formed in a manner to rise in a curved form at the side edges of the liquid coating composition flowing down the slide surface. The edge bead formed at the side edges of the liquid coating composition, so that the bead can be stably formed at the side edges of the liquid coating composition. Thus, the liquid coating composition can be coated on the web to the edge region.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

This invention will hereunder be described in further detail with reference to the accompanying drawings.

Figure 1:
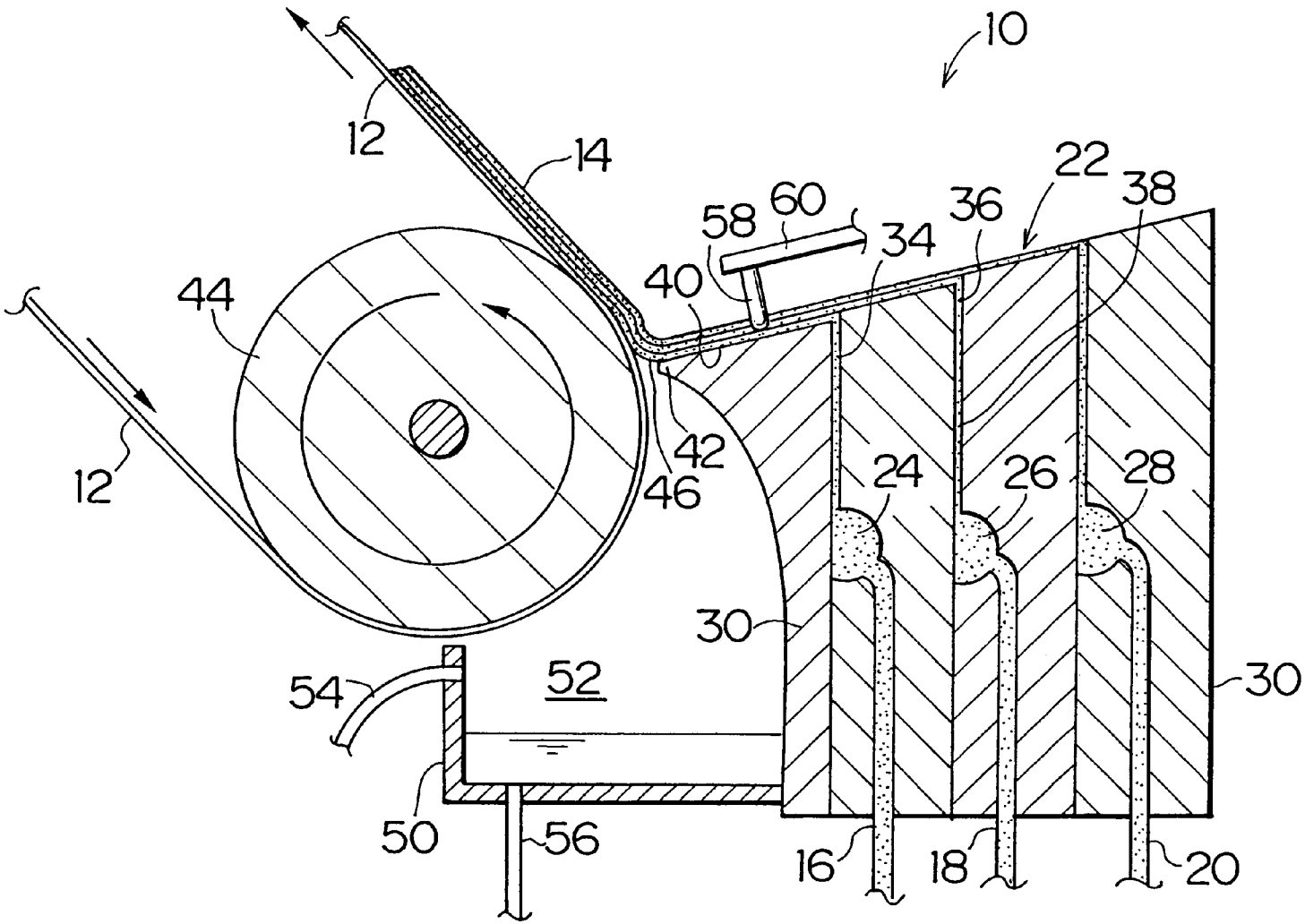
FIG. 1 is a side sectional view illustrating the construction of the first embodiment in accordance with the present invention.

FIG. 1 is a side sectional view illustrating the first embodiment of a slide bead coating apparatus 10 in accordance with the present invention. A plurality of coating solutions in multiple layers are applied to a web 12.

Figure 2:
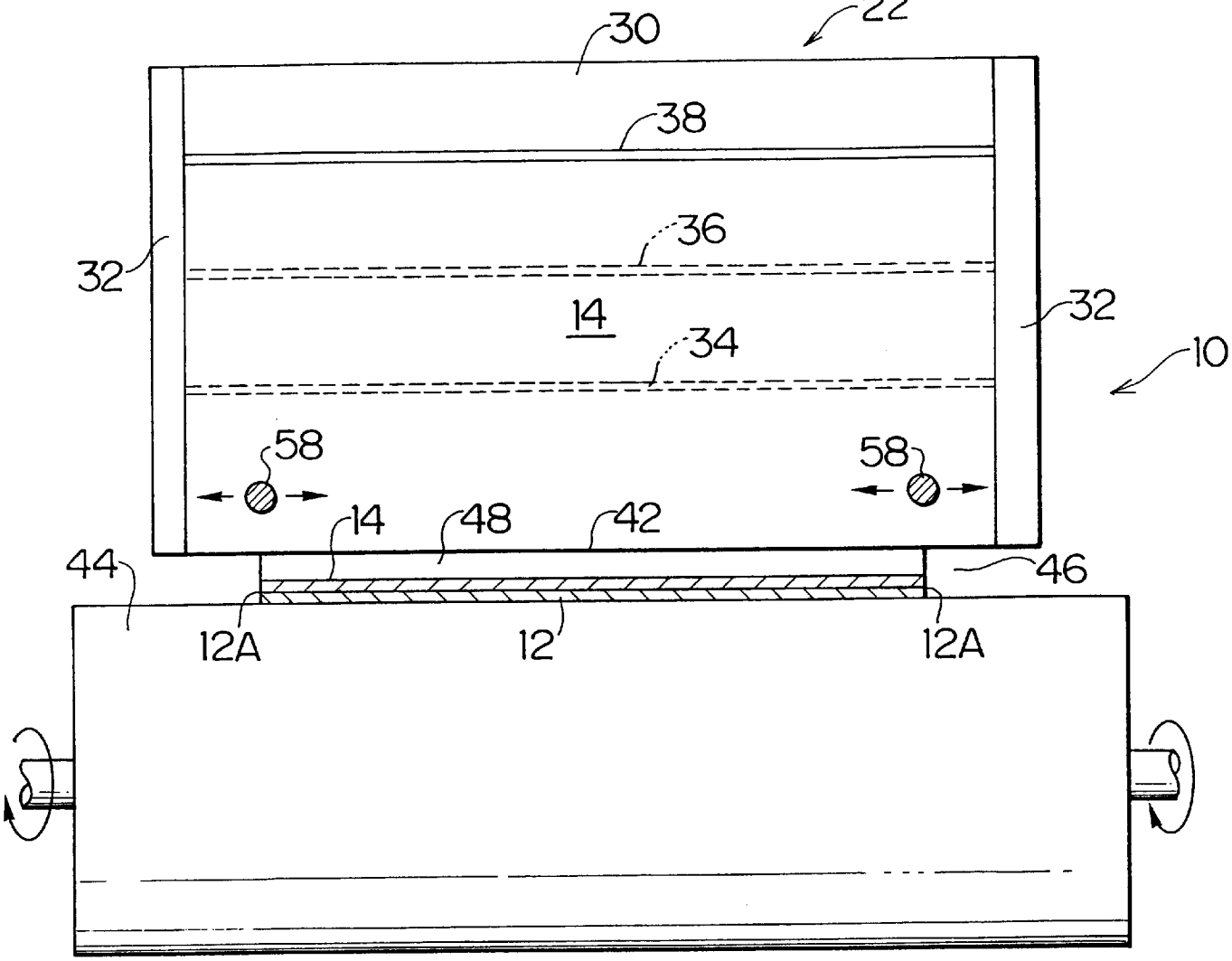
FIG. 2 is a plan view describing the construction of the first embodiment in accordance with the present invention.

As shown in FIGS. 1 and 2, a plurality of coating solutions 14 (three for example) are supplied to manifolds 24, 26, 28 from a coating solution tank (not shown), and they are applied to the web 12. A slide hopper 22 is comprised mainly of multiple die blocks 30 and a pair of side plates 32 which are placed at the side of the die blocks 30. The slide hopper 22 has a plurality of flow passages for the coating solutions 14, such as supply pipes 16, 18, 20, manifolds 24, 26, 28, slits 34, 36, 38, and a slide surface 40. Each coating material 14 supplied to the manifolds 24, 26, 28 extends along the coating width, and is extruded through the slits 34, 36, 38 onto the slide surface 40 which is inclined downward at the top of the slide hopper 22. The coating solutions 14 are extruded onto the slide surface 40 and flow down on the slide surface 40 without mixing, and reach a lip 42 at the bottom end of the slide surface 40. The coating solutions 14 which have reached the lip 42 form a bead 48 in a gap 46 formed between the lip 42 and the web 12 which is traveling on a backup roller 44. Thus, the coating solutions 14 can be applied to the web 12. A suction chamber 52 is formed below the backup roller 44, and it is enclosed by the slide hopper 22, the back-up roller 44 and a chamber forming member 50. An exhaust pipe 54 connects to the side of the chamber forming member 50, and it also connects to vacuum equipment (not shown). The bottom of the chamber forming member 50 connects to a drain pipe 56 which discharges the coating solutions 14 falling into the suction chamber 52. The pressure reducing chamber 52 stabilizes the bead 48 by negative pressure in the suction chamber 52, and enables the marginal coating solutions 14, which are not applied to the web 12, to smoothly flow into the suction chamber 52.

A pair of columnar rods 58 are arranged at both edges of the slide surface 40 in proximity to the lip 42 in a direction perpendicular to the slide surface 40. The pair of columnar rods 58 are slidable along the width of the slide surface 40, and they are supported by a slide/advance and retract mechanism (not shown) via an arm 60 so that the end of the rod 58 can advance to and retract from the slide surface 40. Thus, the pair of rods 58 can be inserted into the coating solutions 14 which are flowing on the slide surface 40.

Figure 3:
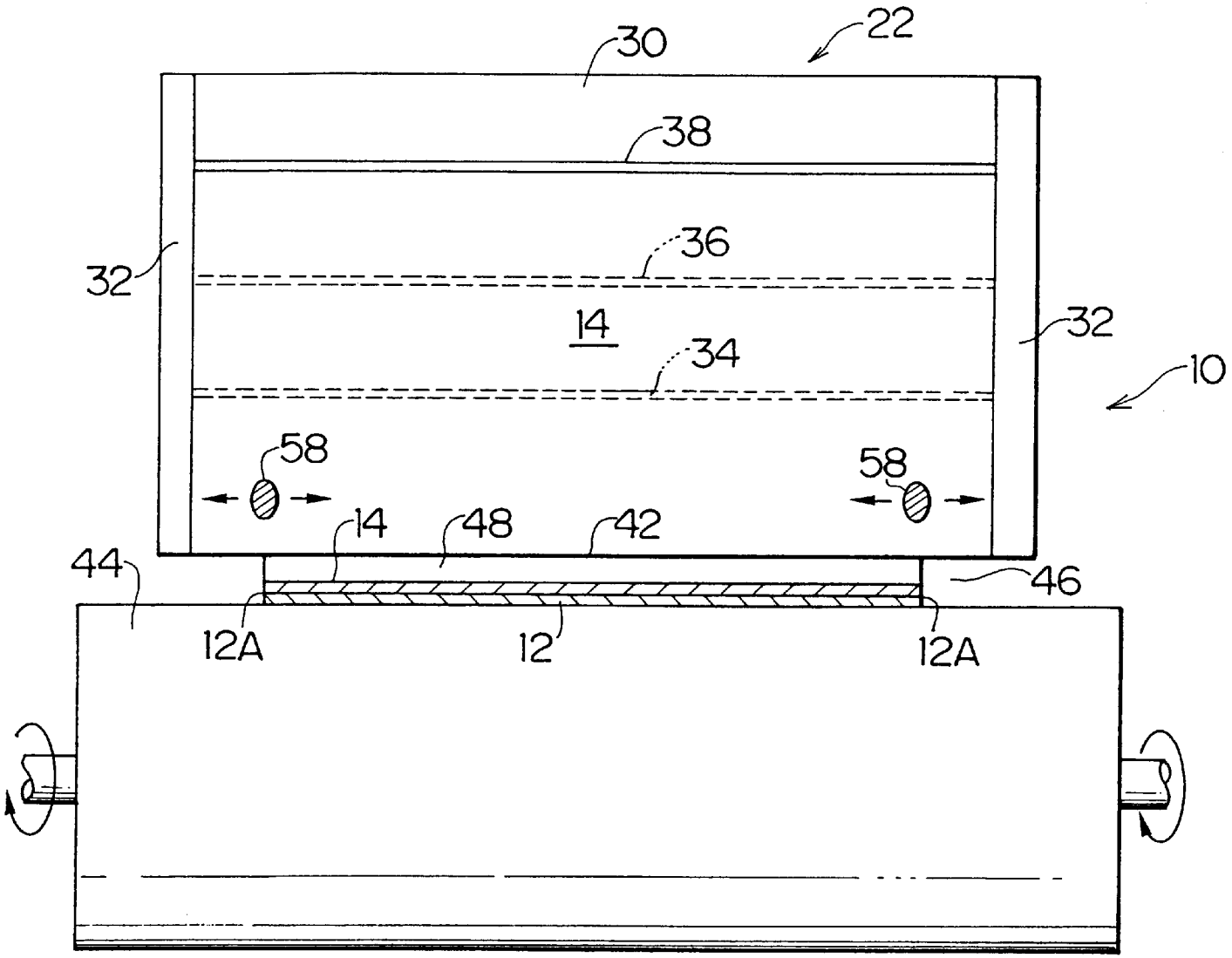
FIG. 3 is a plan view describing the present invention which uses a rod of the streamline section.
Figure 4:
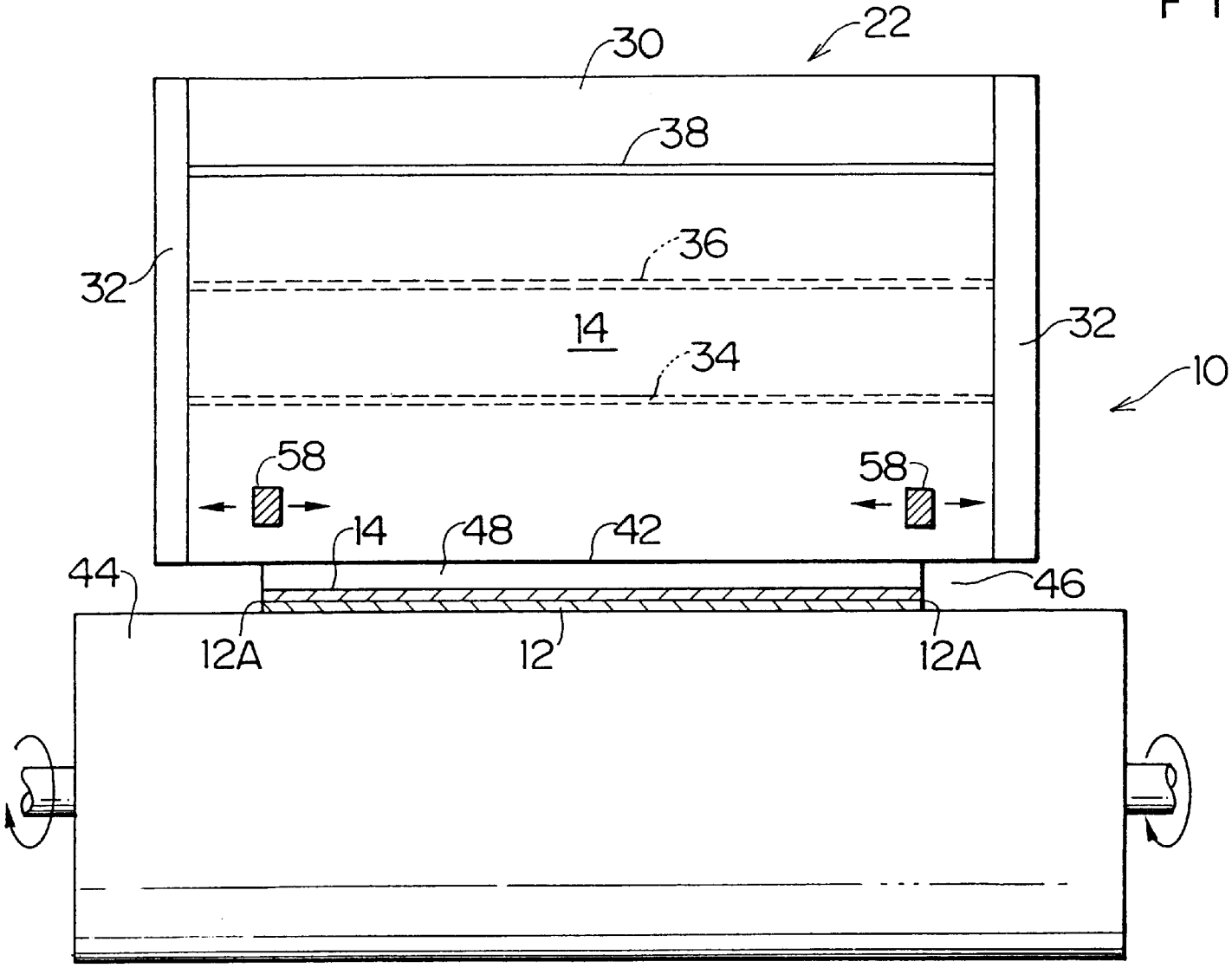
FIG. 4 is a plan view describing the present invention which uses a rod of the rectangular section.
Figure 5:
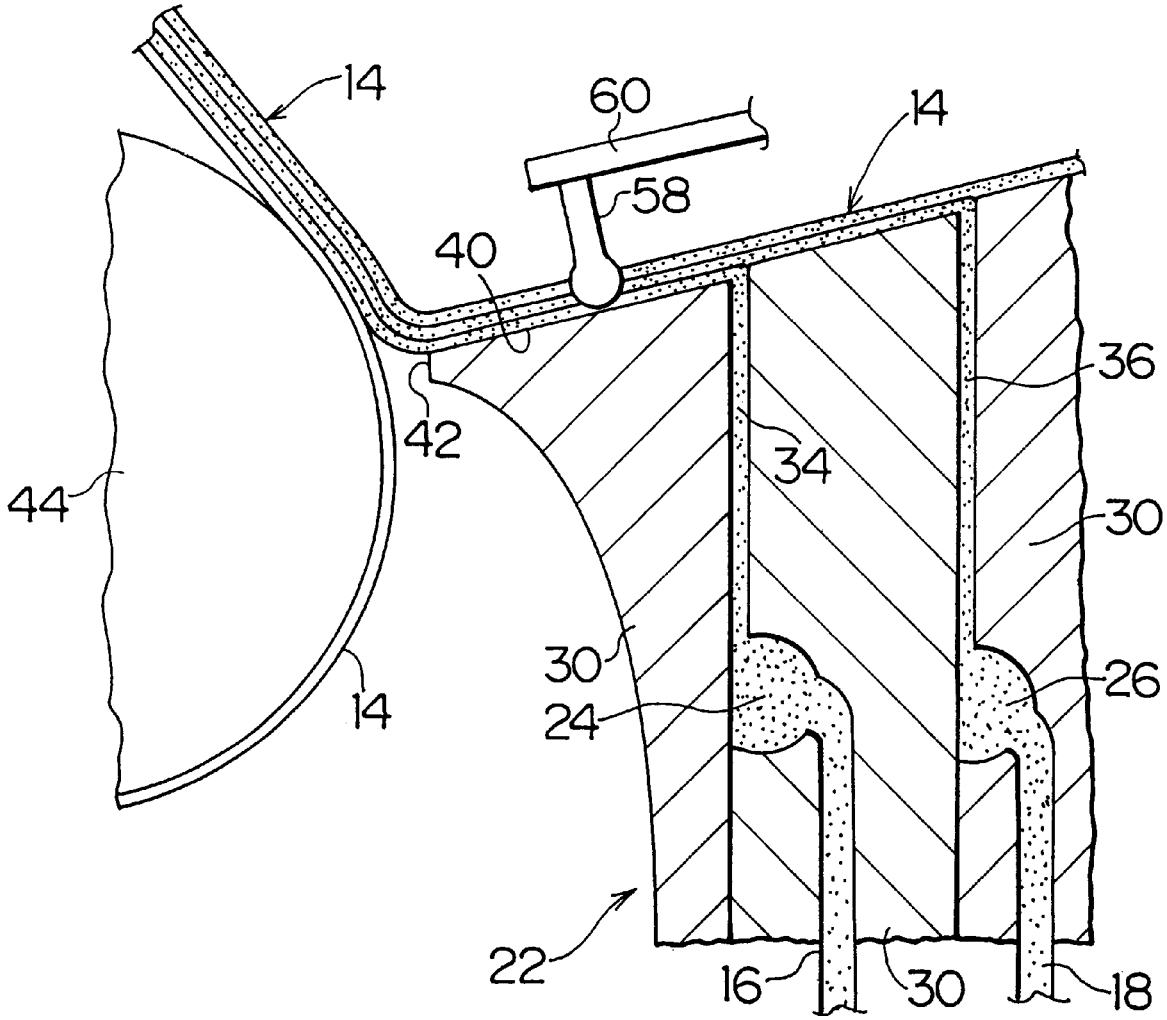
FIG. 5 is a side sectional view describing the present invention which uses a rod whose end is round.
Figure 6:
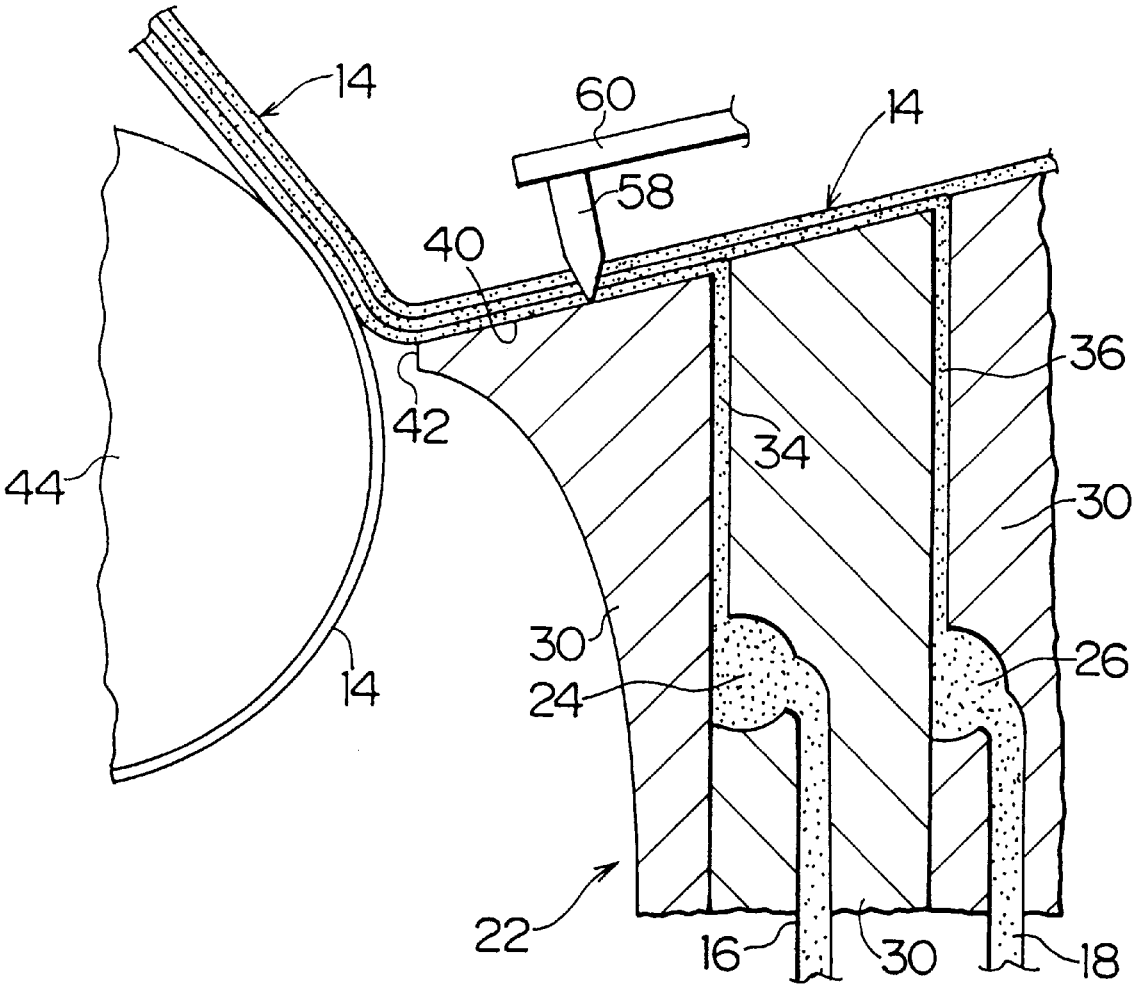
FIG. 6 is a side sectional view describing the present invention which uses a rod whose end is tapered.
Figure 7:
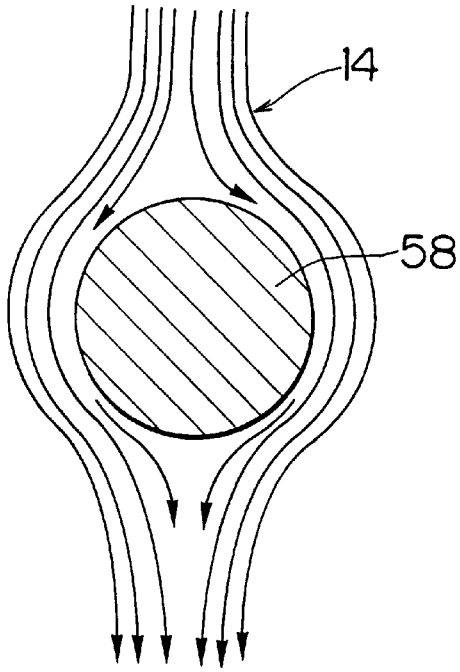
FIG. 7 is a view of assistance in explaining the flow of the coating solutions when the rod is used.

The rod 58 is not necessary columnar, but the section thereof in the direction of its diameter may be streamlined as shown in FIG. 3 or may be rectangular as shown in FIG. 4. The end of the rod 58 may be round as shown in FIG. 5, or a taper may be formed at the end of the rod 58 as shown in FIG. 6.

The diameter of the rod 58 is preferably between several millimeters and several dozens millimeters. If the diameter of the rod 58 is too small, the flow of the coating composition cannot easily be formed in a straight line from the rod 58 to the lip 42 (hereinafter referred to as the rear flow side of the rod 58). On the other hand, if the diameter of the rod 58 is too large, the coating solutions 14, which divide in opposite directions at the rod 58, reach the lip 42 before joining each other.

The material of the rod 58 is not specifically restricted, but is preferably durable against the coating solution. The rod 58 is made of, for example, TEFLON®, plastic and stainless steel, or the material of the rod 58 may be coated with gold.

The distance between the lip 42 and the center of the rod 58 varies according to the diameter of the rod 58 and the flow rate of the coating solutions. In the case of the above-mentioned rod 58, the distance is preferably between 3 mm and 25 mm. That is because, if the distance is too long, the flow of the coating solutions, which become thick at the upper flow side of the rod 58, forms thick coating solutions which are flowing at the center of the slide surface 40 (the original thickness of the solution applied to the web). On the other hand, if the distance is too short, the coating solutions 13, which have divided in opposite directions at the rod 58, reach the lip 42 before joining. Description will hereunder be given of the operation in the first embodiment of the slide bead coating apparatus which is constructed in the above-mentioned manner.

First, in order to prepare for operating the slide bead coating apparatus, the slide mechanism of the slide/advance and retract mechanism is operated so that the center of the rod 58 can correspond to an edge line 12A of the web 12, so as to move the pair of rods 58 along the width of the slide surface 40 (see FIGS. 2, 3 and 4). In this case, if the center of the rod 58 is displaced with respect to the edge line 12A of the web 12 by ± several millimeters along the width of the slide surface, it has no effect on application of the coating solutions to the edge region of the web 12.

Then, the coating solutions 14 in multiple layers flow down the slide surface 40 of the slide hopper 22, and the advance and retract mechanism of the slide/advance and retract mechanism is operated, so that the end of the rod 58 can be dipped in the coating solutions 14 which are flowing on the slide surface 40. The end of the rod 58 is inserted into the coating solution in a manner to be dipped in the bottom layer of the coating solutions 14 having multiple layers. In this case, before the coating solutions 14 start flowing down the slide surface 40, it may be determined beforehand that the end of the rod 58 is properly dipped in the coating solution. There is no problem if the end of the rod 58 contacts the slide surface 40. If, however, the end of the rod 58 is inserted to such an extent as not to contact the slide surface 40, the coating solutions 14 can flow in the space between the slide surface 40 and the end of the rod 58. Thus, the flow of the coating solutions 14 can be stabilized without occurrence of turbulence, etc.

Figure 8:
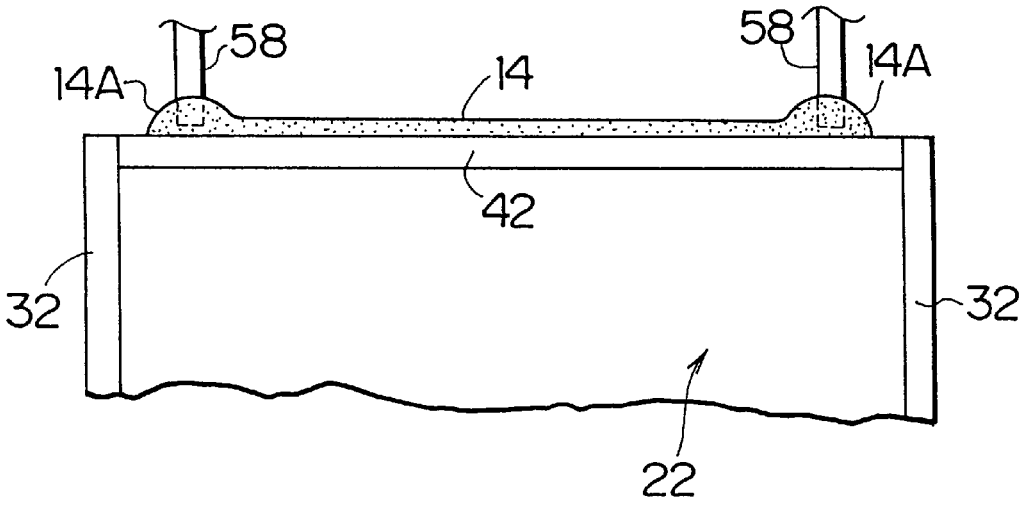
FIG. 8 is a view describing the operation of the rod.

When the rod 58 is inserted into the coating solution, the coating solutions 14 fall from the front surface of the rod 58, and contacts the rod 58 to divide in opposite directions. The coating solutions 14 join again at the rear flow side of the rod 58. As shown in FIG. 8 (the view taken from the front of the coating hopper), there is a flow 14A of the edge bead in which the longitudinal section of the coating solution rises in a curved form. The flow 14A of the edge bead is formed at both side edges of the coating solution 14, thereby stabilizing the formation of the bead at both side edges of the coating solution 14. Thus, the coating solutions 14 can be applied to the web 12 up to the edge. In this case, the coating solutions 14 flow down several millimeters away from the rod 58 into the suction chamber 52 without being applied to the web 12.

Thus, the slide bead coating apparatus 10 is able to apply the coating solutions 14 to the edge region of the web 12 in the simple construction in which the rod 58 is inserted into the coating solutions 14 flowing down the slide surface 40.

If the rod 58 is positioned several millimeters away from the web edge 12A, the composition of the coating solutions 14 flows down at the outside of the rod 58 without being applied to the web 12. Thus, the coating solutions 14 may not be applied to the edge region of the web 12 on purpose.

As stated above, the slide bead coating apparatus 10 of the present invention is able to adjust the width of the coating solutions 14 by arranging a pair of rods 58 on the edge line 12 of the web 12. In this case, if the width of the web 12 changes, the rod 58 moves so as to correspond to the edge line 12A of the web 12 to be coated next. Thus, the width of the coating solutions 14 can be adjusted without stopping the coating process.

The slide bead coating apparatus 10 of the present invention preferably uses a pair of rods 58. Depending on the situation, the rod 58 may be used only at one side of both side edges of the coating solutions 14, and a conventional guide plate may be used at the other side.

The second embodiment of the slide bead coating method and apparatus according to the present invention will now be explained.

Figure 9:
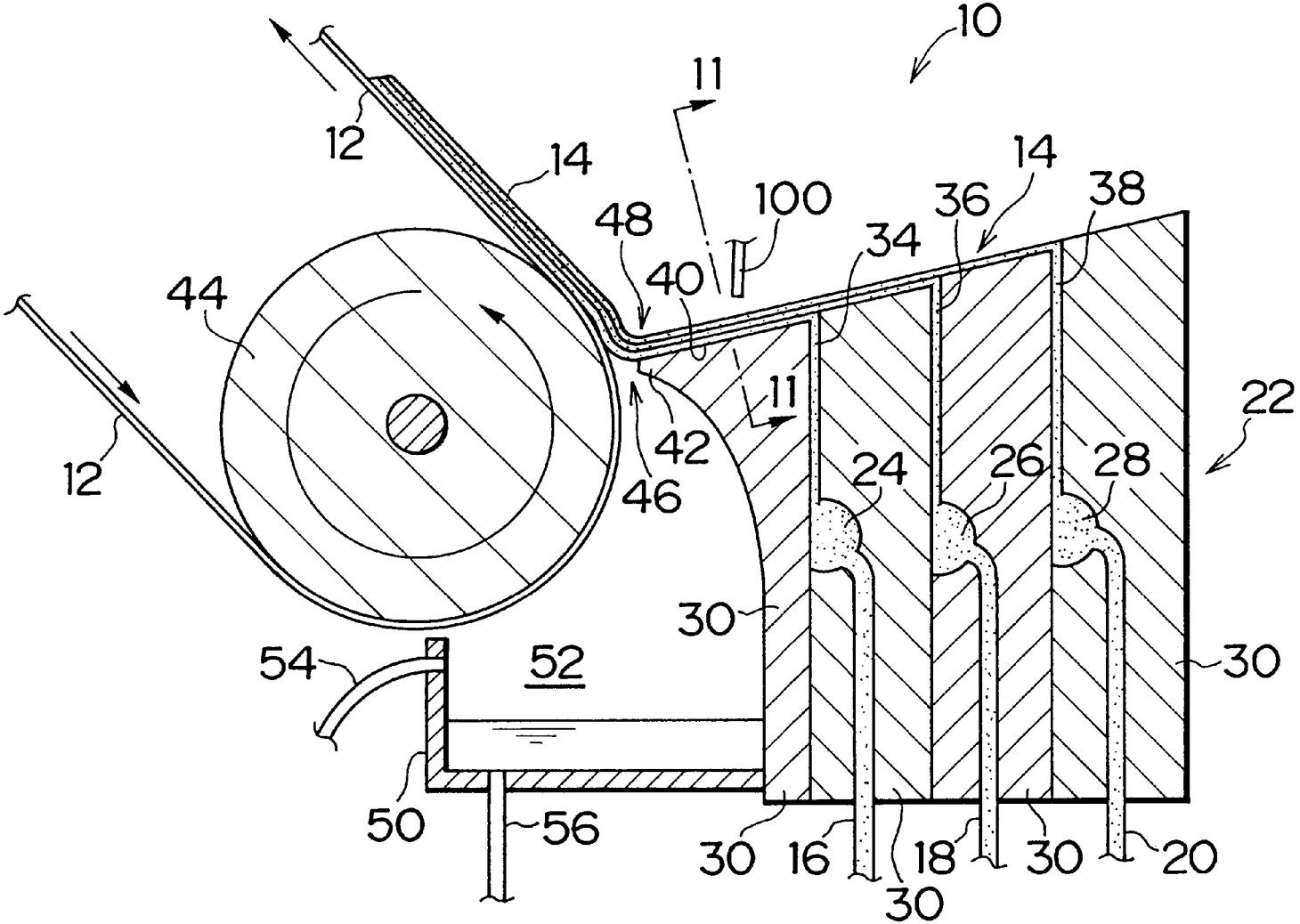
FIG. 9 is a side sectional view describing the second embodiment in accordance with the present invention.
Figure 10:
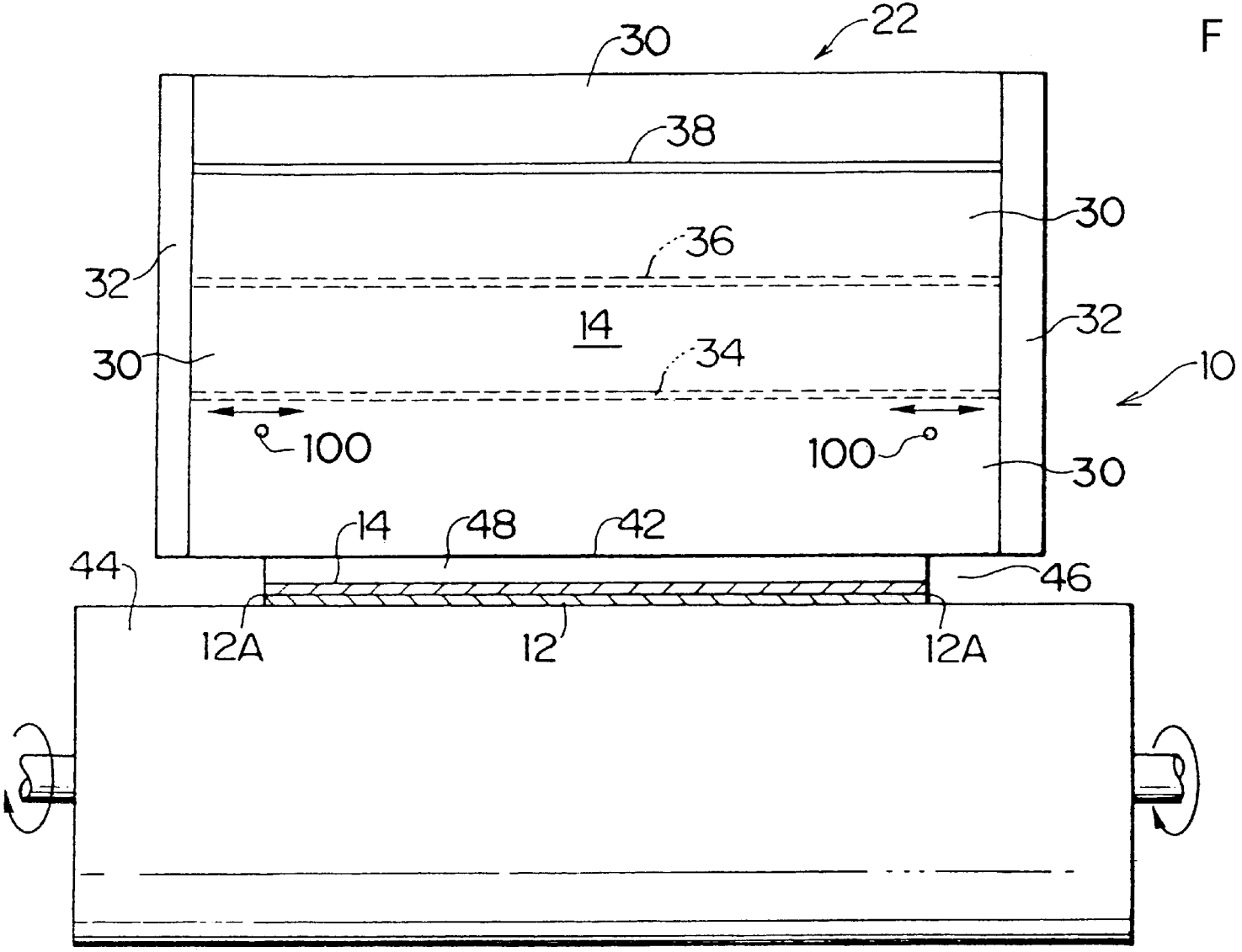
FIG. 10 is a plan view describing the second embodiment in accordance with the present invention.

FIGS. 9 and 10 are views describing the second embodiment for the slide bead coating apparatus according to the present invention. FIG. 9 is a side sectional view, and FIG. 10 is a plan view.

In the second embodiment, there is provided a nozzle which discharges a discharged liquid 115 to the surface of the coating solution flowing down, instead of the rods 58 in the first embodiment described with reference to FIG. 1. That is, a pair of tube-like nozzles 100 are provided at both side edges of the slide surface 40 in proximity to the lip 42, and they discharge the coating solutions 14 or the composition of the coating solutions 14 (hereinafter referred to as a discharged liquid). The pair of nozzles 100 add the discharged liquid to the surface of the coating solutions 14 which flow down the slide surface 40. The pair of nozzles 100 are connected to a discharged liquid supply apparatus via a discharge control valve (not shown). The examples of the discharged liquid 115 are the main solvent of the coating solutions 14, the main solvent coated with a surface active agent, a mixture of multiple coating solutions 14, and the mixture which is diluted by the solvent. In the case of the coating solutions 14 in multiple layers, the delivered liquid 115 from the nozzle 100 must be composed of the coating solutions in the top layer or the composition of the coating solutions in the top layer.

A pair of the nozzles 100 are supported by a slide mechanism (not shown) in a manner to be slide along the width of the slide surface 40.

Description will hereunder be given about the operation of the second embodiment for the slide bead coating apparatus 10 which is constructed in the above-mentioned manner.

In order to prepare for operating the slide bead coating apparatus 10, the slide mechanism is operated so that the center of the nozzle 100 can correspond to the edge line 12A of the web 12. A pair of the nozzles 100 slide along the width of the slide surface 40 (see FIG. 10). In this case, depending on the diameter of the nozzle 100 and the flow rate of the coating solutions, if the center of the nozzle 100 is displaced ± several millimeters from the edge line 12 of the web 12 along the width of the slide surface, there is no problem when the coating solutions are applied to edge region of the web 12.

Figure 11:
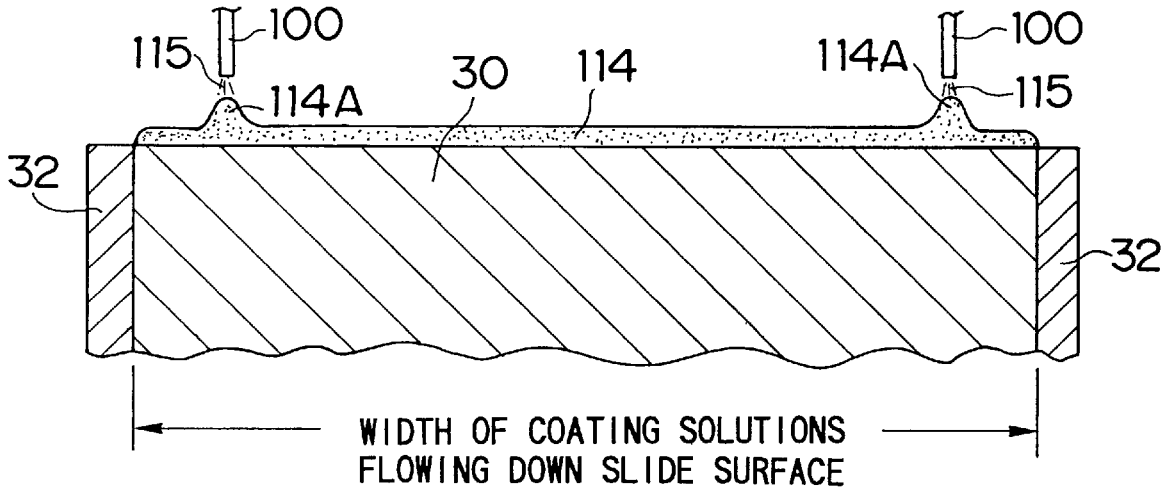
FIG. 11 is a view describing the operation of the second embodiment in accordance with the present invention.

Next, the coating solutions 14 in multiple layers flow down on the slide surface 40 of the slide hopper 22. The nozzles 100 discharge the discharged liquid 115 to the surface of the coating solutions flowing down the slide surface 40. As shown in FIG. 11 (the sectional view taken along line 11—11 of FIG. 9), the discharged liquid 115 from the nozzle 100 is added to the coating solutions, and a flow forms in which the longitudinal section rises in a curved form at both side edges in the direction of the width of the coating solutions 14 flowing down the slide surface 40. The formation of the bead can be stabilized at both side edges of the coating solutions 14 can be stabilized by forming the flow of the edge bead 114A at both side edges of the coating solutions 14. Thus, the coating solutions 14 can be applied to the edge bead of the web 12. In this case, the coating solutions 14 flow at the outside of the edge bead 14A into the suction chamber 52 without being applied to the web 12.

Thus, in the second embodiment, the slide bead coating apparatus 10 of the present invention is constructed in such a way that the discharged liquid 115 from the nozzle 100 is applied on the surface of the coating solutions 114 flowing down the slide surface 40. Thus, the coating solutions 14 can be applied to edge region of the web 12 without fail.

The diameter (the inner diameter) of the nozzle 100 is preferably between approximately 0.3 mm and 10 mm, and more preferably between 2 mm and 5 mm. If the diameter of the nozzle is too small, the discharge from the nozzle 100 is too small to form the flow of the edge bead 14A. On the other hand, if the diameter of the nozzle is too large, the discharge is too large to make the film too thick at the side edge of the coating solutions, and the thickness of the coating solutions applied to the side edge of the web is too thick. If the diameter of the nozzle is too large, the discharged liquid 115 disturbs the coating solutions 14 flowing down the slide surface 40, and the thickness of the film at the center of the coating solutions 14 cannot be even.

The distance between the center of the nozzle 100 and the lip 42 varies according to the diameter of the nozzle 100 and the flow rate of the coating solutions 14 flowing down the slide surface 40. The distance is preferably between 3 mm and 20 mm. If the distance is too long, the edge bead 114A formed by the solution from the nozzles 100 forms the original thickness of the coating solutions 14 flowing thoroughly the center of the slide surface 40 before the coating solutions 14 reach the lip 42. On the other hand, if the distance is too short, the coating solutions 14 reach the lip 42 before the edge bead 114A is formed.

The discharge rate of the discharged liquid from the nozzles 100 is preferably between 0.05 m/s and 5 m/s. If the discharge rate is too low, the discharge is small per a time unit and the edge bead 114A cannot be formed. On the other hand, if the discharge rate is too high, the discharge pressure disturbs the application, and thus, the edge bead 114A cannot be formed. Moreover, if the discharge rate is too high in the case of the coating solutions 14 composed of multiple layers, the discharge pressure disturbs the surface of multiple layers.

In the second embodiment for the slide bead coating apparatus 10 according to the present invention, the coating solutions 14 are applied to the edge region of the web 12. If, however, the nozzles 100 are positioned several millimeters away from the web edge 12A, the coating solutions 12 which flow down at the outside of the nozzles 100 are not applied to the web 12. Thus, the coating solutions 14 may not be applied to the edge region of the web 12 on purpose.

As stated above, according to the second embodiment for the slide bead coating apparatus 10 of the present invention, a pair of nozzles 100 are arranged on the edge line 12A of the web 12 in a manner to correspond to the width of the web 12, so that the width of the coating solutions 14 can be adjusted. In this case, if the width of the web 12 changes, the nozzles 100 may move so as to correspond to the edge line 12 of the web 12 to be coated next. Thus, the width of the coating solutions 14 can be adjusted without stopping the coating process.

In the second embodiment of the present invention, the slide bead coating apparatus 10 of the present invention preferably uses a pair of nozzles 100. Depending on the situations, the nozzle 100 may be used only at one side of both side edges of the coating solutions 14, and a conventional guide plate may be used at the other side.

Figure 12:
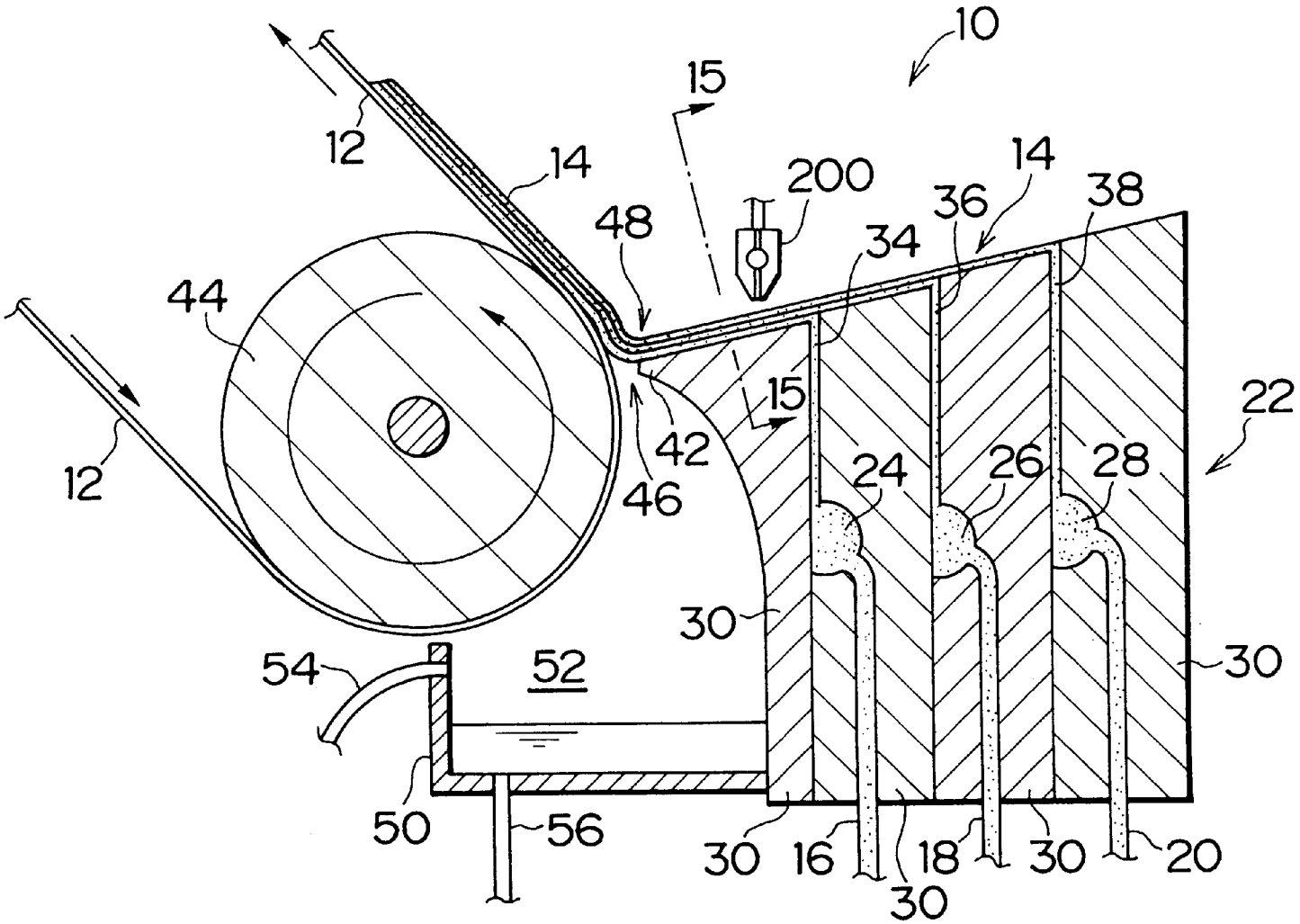
FIG. 12 is a side sectional view of an example of the modified second embodiment according to the present invention.
Figure 13:
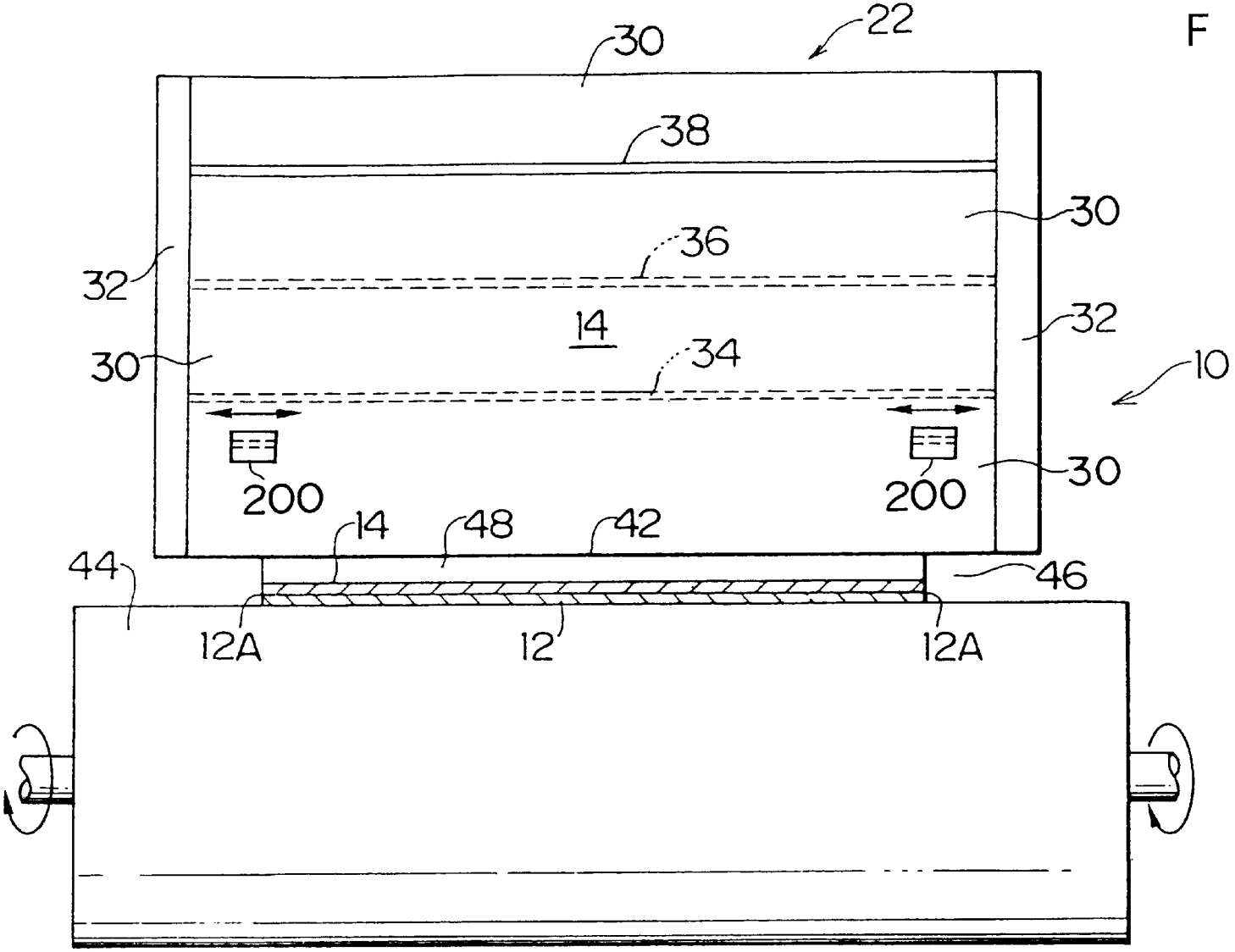
FIG. 13 is a plan view of an example of the modified second embodiment according to the present invention.

FIGS. 12 and 13 are views illustrating an example of the modified second embodiment of the slide bead coating apparatus 10 according to the present invention. FIG. 12 is a side sectional view, and FIG. 13 is a plan view. Parts similar to those described in the second embodiment are denoted by the same reference numerals, and the description is omitted.

In an example of the modified second embodiment for the present invention, a slit-type nozzle 200 is employed instead of the tube-like nozzle 100 in the second embodiment. Other parts are similar to those used in the second embodiment.

Figure 14:
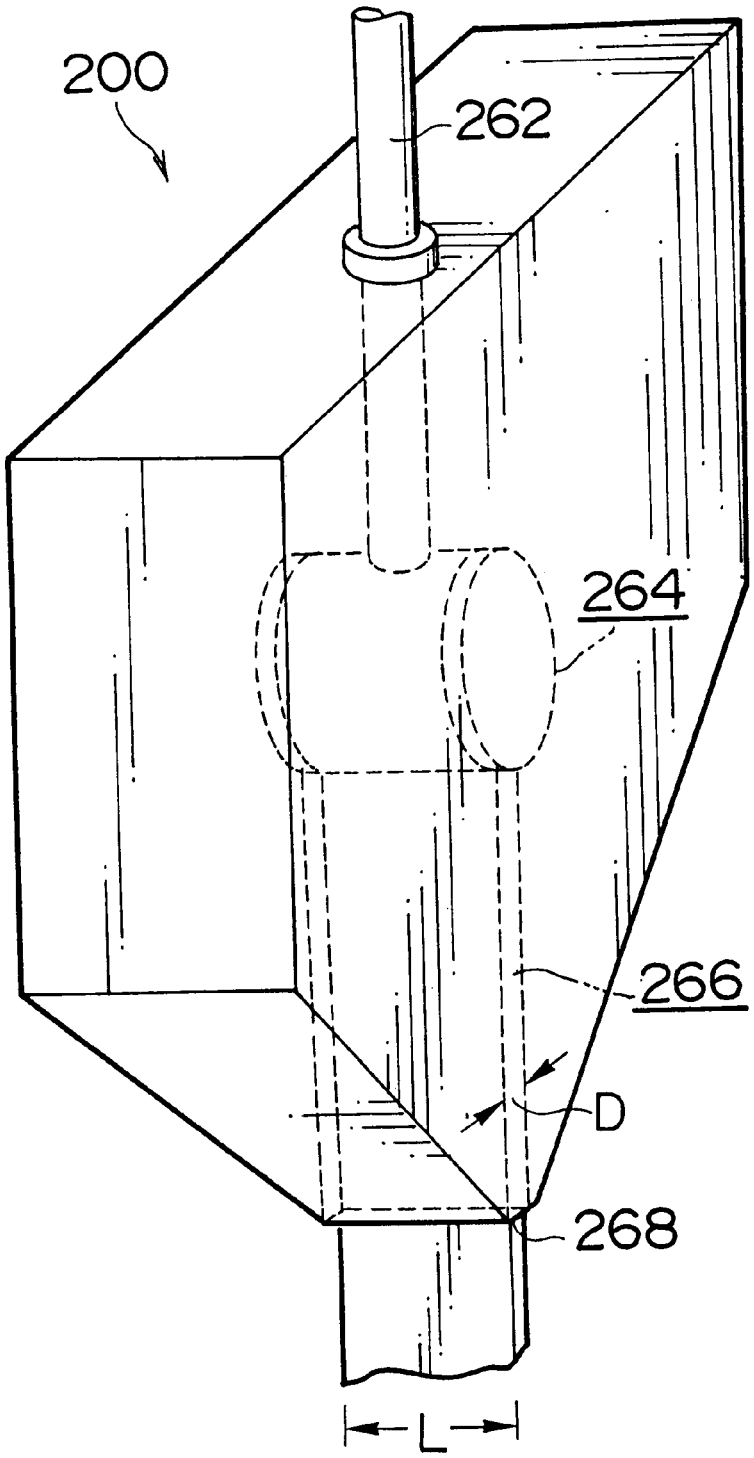
FIG. 14 is a view describing the structure of slit-like nozzles.

As shown in FIGS. 12 and 13, a pair of the slit-type nozzles 200 which discharge the coating solutions 14 is provided between an area at both side edges of the slide surface 40 and in proximity to the lip 42 and an area in proximity to the slit 34 through which the coating solutions 14 are extruded. Each slit-type nozzles 200 connect to discharged liquid supply equipment via a discharge control valve (not shown). As shown in FIG. 14, the slit-type nozzles 200 is constructed in such a way that the discharged liquid 15 from the discharged liquid supply equipment is supplied to the manifold 264 through a supply tube 262 and is discharged through a discharge outlet 268 via a slit path 266. The discharged liquid 115 from the discharge outlet 268 is added to the coating solutions 14 flowing down the slide surface 40. The pair of slit-like nozzles 200 are supported by a slide mechanism (not shown) in a manner to be slide along the width of the slide surface 40.

Figure 15:
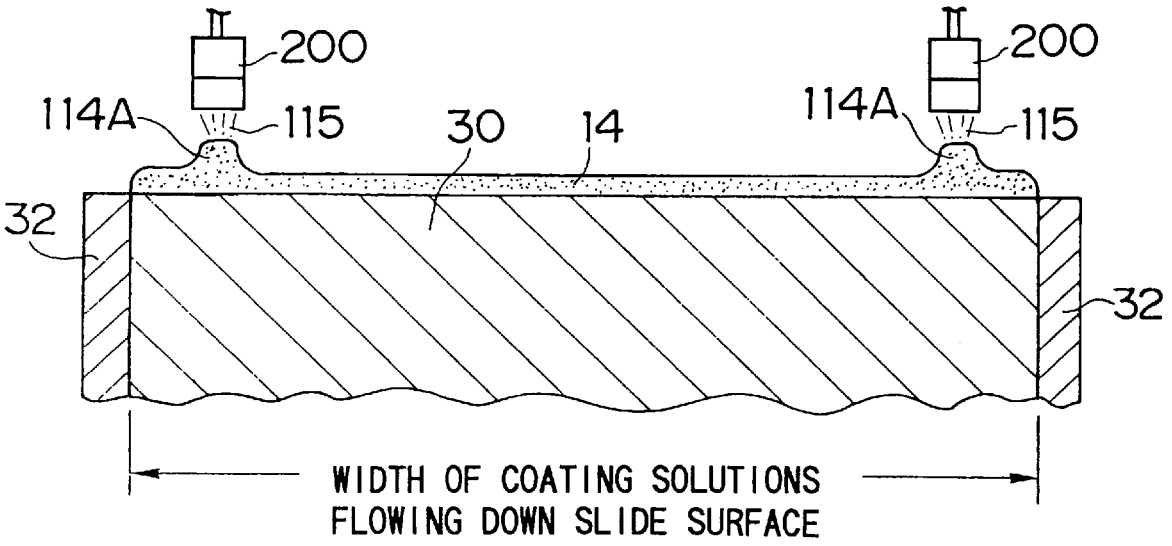
FIG. 15 is a view describing the operation in the example of the modified second embodiment according to the present invention.

According to the example of the modified second embodiment for the present invention, the discharge liquid 115 from the slit-like nozzles 200 arranged on the slide surface 40 is applied on the coating solutions flowing down the slide surface 40 while the curtain is formed. As shown in FIG. 15 (the sectional view taken along line 15—15 in FIG. 12), the flow of the edge bead 114A is formed so that the longitudinal section rises at both side edges in the direction of the width of the coating solutions 14 flowing on the slide surface 40.

Thus, the modified second embodiment can achieve the same effects as the second embodiment. In the modified second embodiment, as shown in FIG. 15, the discharged liquid 115 is applied on the coating solutions 14 flowing on the slide surface 40 while the curtain is formed. By forming the trapezoid edge bead 114A wider than the tube-like nozzle 100 in the second embodiment, the formation of the bead can be more stable than in the second embodiment.

The width (L) of the slit-like nozzle is preferably between 3 mm and 20 mm. If the slit is too thin, the width of the edge bead 114A is too small, thereby causing some troubles in the formation of the bead. If the slit which is too wide, the thickness at the center of the liquid film is affected.

The flow rate of the coating solutions 14 per unit width (the flow which is discharged through the slit of 1 cm per second) is preferably between 0.02 ml/cm•sec and 10 ml/cm•sec. If the flow rate per unit width is too small, the discharge per unit time is too small to form the edge bead 114A. On the other hand, if the flow rate per unit width is too large, the discharge is too much, and thus the edge bead 1 14A at the side edge of the coating solutions is too wide. In this case, too much coating solutions are applied to the side edge of the web.

The clearance (D) of the slit-like nozzle 200 is preferably between 0.02 mm and 1.5 mm. If the clearance is too small when the slit-like nozzle 200 discharges the viscous liquid 115, the discharged liquid 115 cannot be smoothly discharged through a discharge outlet 268. Thus, the edge bead 1 14A cannot be properly formed. On the other hand, if the clearance is too large, the edge bead 114 A is formed from the side edge to the center of the coating solutions because too much liquid is discharged. The thickness of the coating solutions cannot form the original thickness, and the flow of the coating solutions flowing on the slide surface 40 is disturbed.

The slit-like nozzles 200 are preferably arranged so that the center of the slit can correspond to the edge line 12A of the web 12. There is no problem if the center of the slit is displaced ±10 mm from the edge line 12A. A turbulence is generated in the flow of the coating solutions 14 flowing down the slide surface 40.

The slit-like nozzles 200 are preferably between 3 mm and 20 mm from the lip 42. If the discharge outlet 268 is too far apart from the lip 42, the flow of the coating solutions 14 having the edge bead 114A forms the original thickness of the coating solutions flowing through the center of the slide surface 40 before reaching the lip 42. On the other hand, the discharge outlet 268 is too close to the lip, the coating solutions 14 reach the lip 42 before the edge bead 114A is formed.

Figure 16:
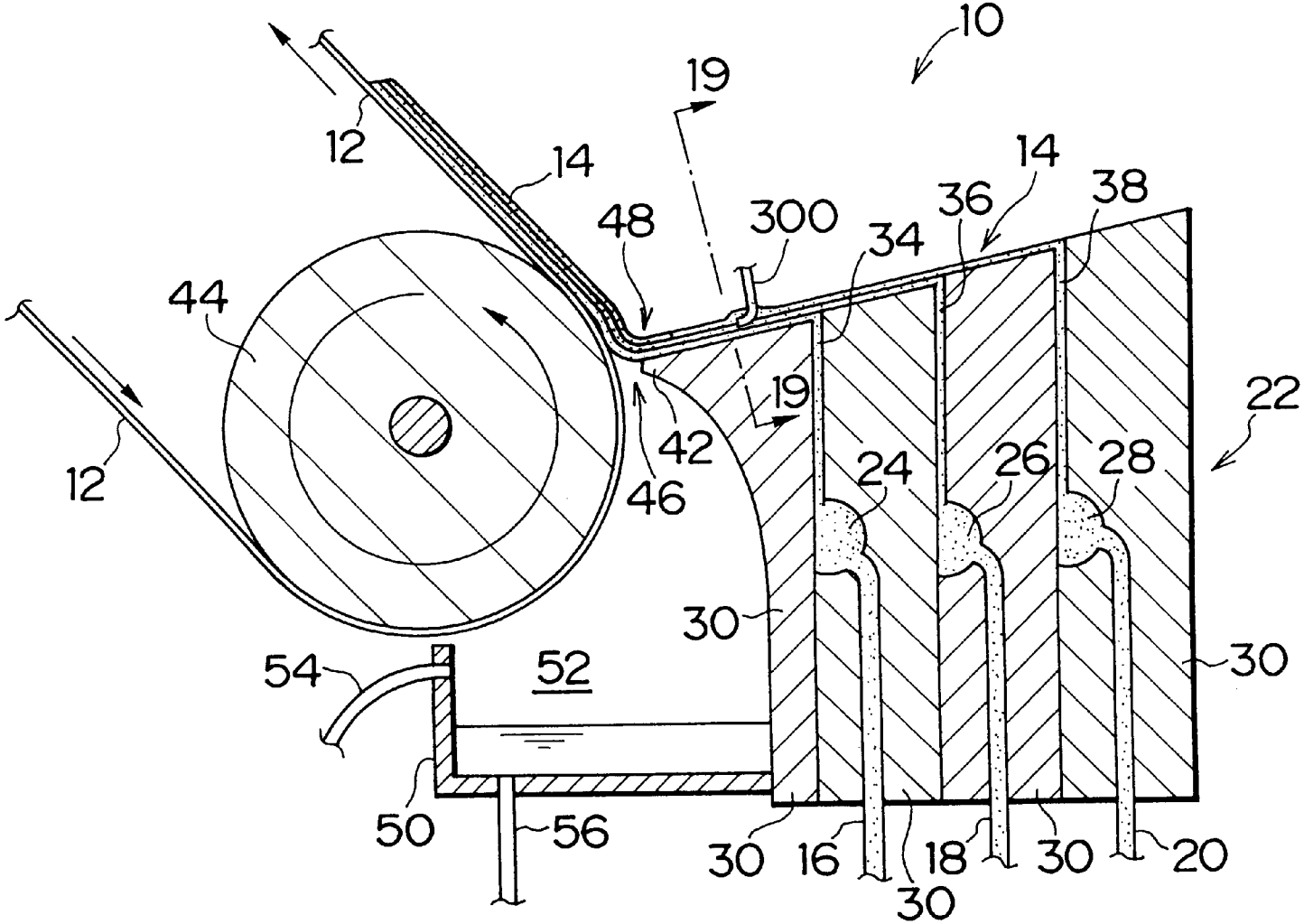
FIG. 16 is a side sectional view of assistance in explaining another example of the modified second embodiment according to the present invention.
Figure 17:
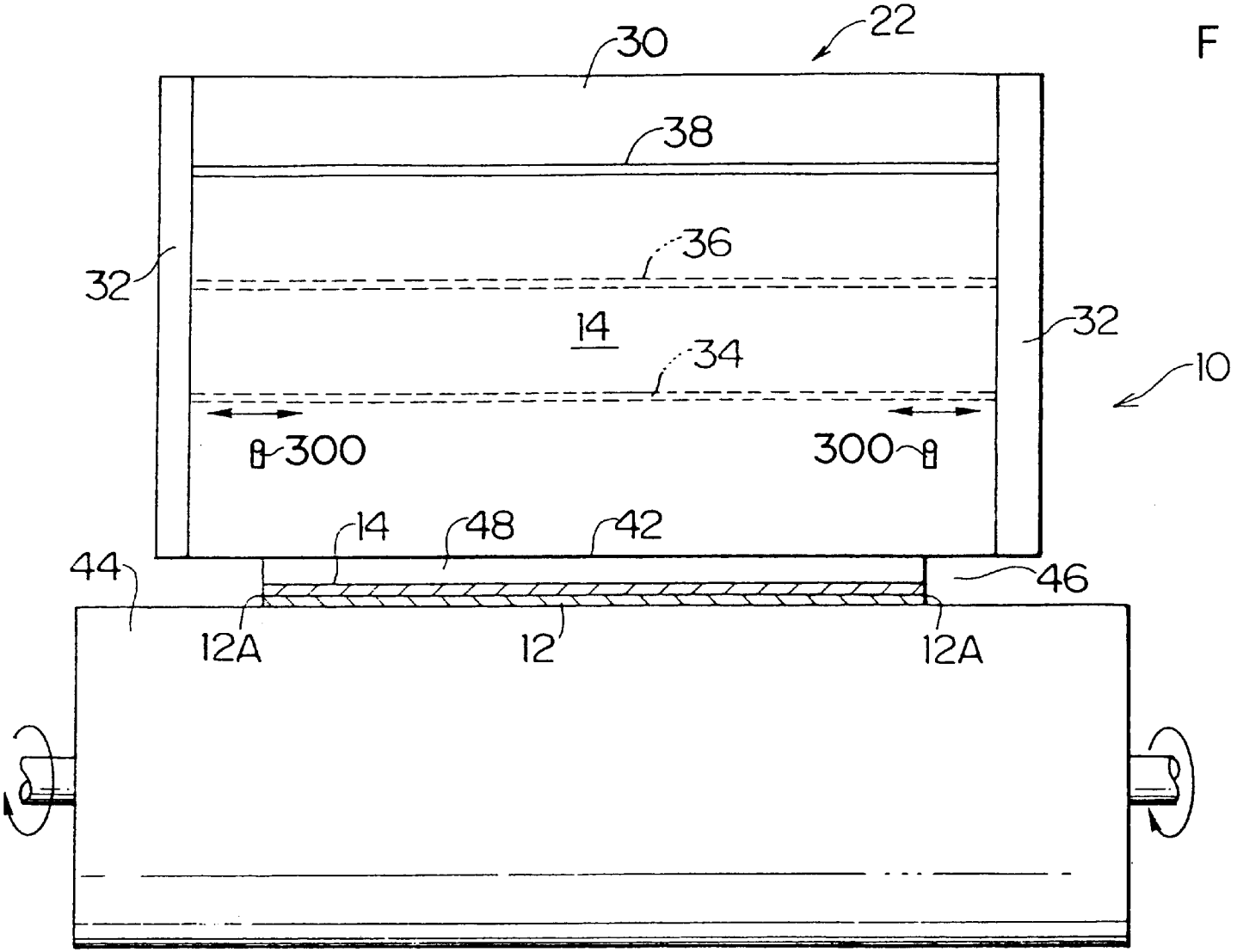
FIG. 17 is a plan view describing another example of the modified second embodiment according to the present invention.

FIGS. 16 and 17 are views describing another example of the modified second embodiment for the slide bead coating apparatus 10 according to the present invention. FIG. 16 is a side sectional view, and FIG. 17 is a plane view.

In another example of the modified second embodiment for the present invention, a tube-like injection nozzle 300 is inserted into the coating solutions 14 flowing down the slide surface 40, and the discharge liquid 115 from the injection nozzle 300 is injected into the liquid film. Other apparatuses, members and the injected liquid are similar to those in the second embodiment. A pair of injection nozzles 300 are supported by a slide mechanism (not shown) in a manner to be slidable along the width of the slide surface 40 as is the case in the second embodiment.

Figure 18:
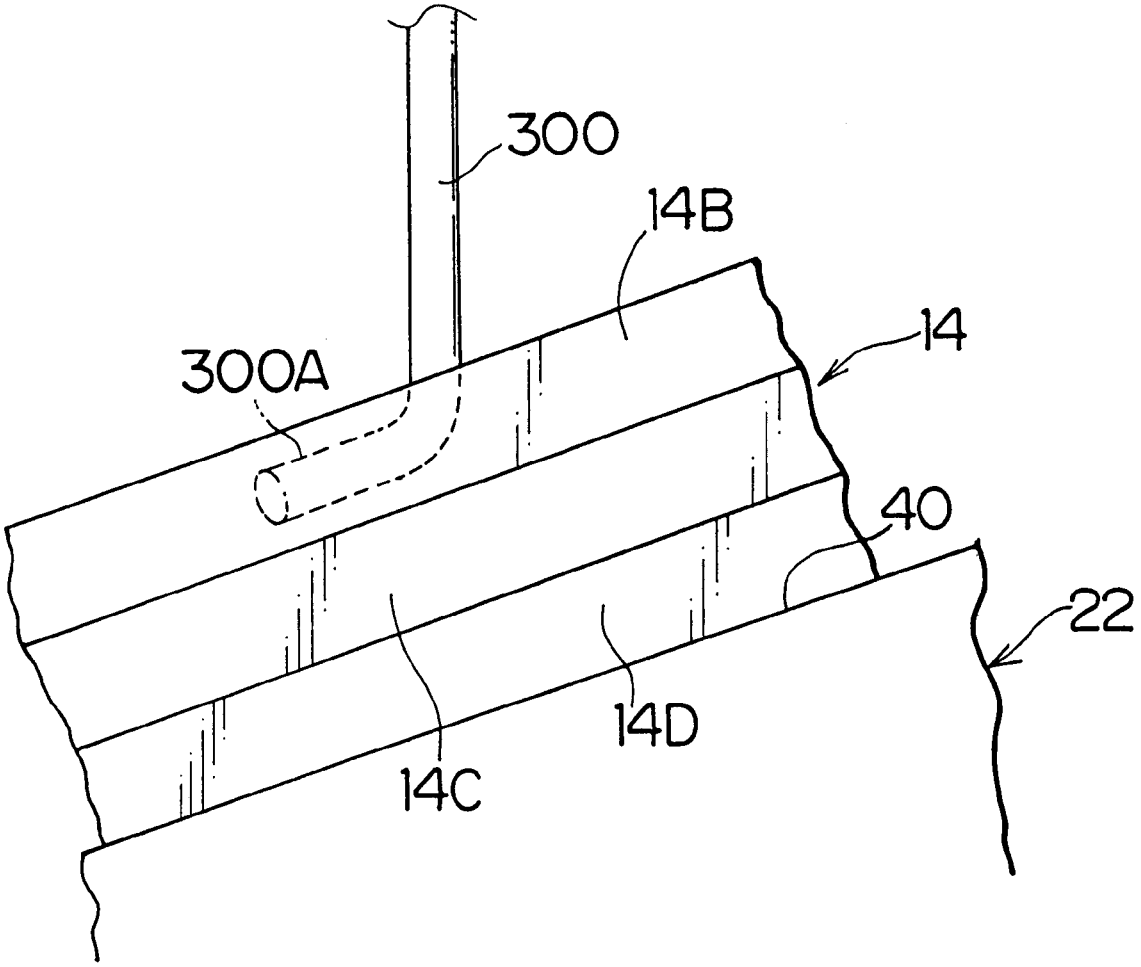
FIG. 18 is a view of assistance for explaining a relation between an injection nozzle and a slide surface.

As shown in FIG. 18, the injection nozzle 300 is bent so that an end 300A of the injection nozzle 300 can be parallel to the slide surface 40. The end of the injection nozzle 300 is bent in the flowing direction of the coating solutions 14 flowing down the slide surface 40, thereby preventing the turbulence in the flow of the coating solutions 14. In this example of the modified second embodiment, the slit-like nozzle 200 can be employed. The slit width (L) must be determined so as not to disturb the flow of the coating solutions 14.

Figure 19:
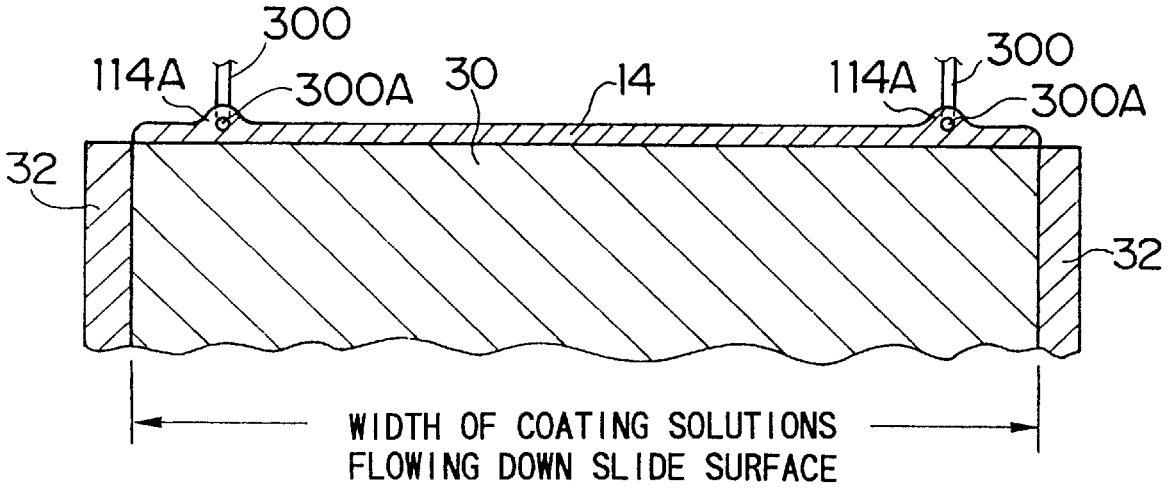
FIG. 19 is a view of assistance for explaining the operation of another example of the modified second embodiment for the present invention.

According to another example of the modified second embodiment for the present invention, the discharged liquid 15 is discharged from the injection nozzle 300, which is inserted into the coating solutions 14 flowing down the slide surface 40, and the discharged liquid 15 is injected into the coating solutions 14 flowing down the slide surface 40. As shown in FIG. 19 (the sectional view taken along line 19—19 of FIG. 16), the flow of the edge bead 114A is formed in which the longitudinal section rises in a curved form at both side edges of the coating solutions 14 flowing down the slide surface 40. In this case, if the coating solutions 14 flowing down the slide surface 40 are composed of multiple layers, for example three layers (14B, 14C, 14D) as shown in FIG. 18, the injection nozzle 300 is inserted into the coating solutions in the top layer, and the discharged liquid 115 from the injection nozzle 300 is injected into the top layer 14B.

In the above-mentioned another example of the modified second embodiment, the same effects can be achieved as in the second embodiment. In this example, the injection nozzle 300 is injected into the coating solutions 14, thereby forming the edge bead 114A at the rear flow side of the injection nozzle 300. In addition, the discharged liquid 115 is injected into the coating solutions 14. Thereby, if the coating solutions 14 flows down on the slide surface 40 at high speed, the edge bead 114A can be formed without fail.

The coating solutions 14 in the present invention include a variety of liquid compositions according to the use, such as a coating solution used for forming a sensitive emulsion layer, an undercoating layer, a protective layer and a back layer for a photosensitive material; a coating solution used for forming a magnetic layer, an undercoating layer, a lubricant layer, a protection layer and a back layer for a magnetic recording material; and a coating solution for forming an adhesive layer, a coloring layer and a rust protection layer. These coating solutions include a water-soluble binder-and an organic binder.

The web 12 for use in the present invention includes paper, plastic film, metal, resin-coated paper, synthetic paper, and the like. The material of the plastic film is polyolefine such as polyethylene and polypropylene; vinyl-polymer such as polyvinylacetate, polyvinylchloride and polystyrene; polyamide such as 6,6-nylon and 6-nylon; polyester such as polyethylene terephthalate and polyethylene-2,6-naphthalate; polycarbonate; and cellulose-acetate such as cellulosetriacetate and cellulosediacetate. A typical example of the resin used for the resin coated paper is polyolefine such as polyethylene, but the present invention is not restricted to this. An example of a metal web is an aluminum web.

EXAMPLE

Example 1

An example in the first embodiment of the slide bead coating apparatus according to the present invention will be explained.

TABLE 1 shows the composition and viscosity of the coating solution.

TABLE 1

| Composition of coating solution | Ratio of composition (wt %) |
|---|---|
| Acrylic copolymer | 10.0 |
| Ethylene gricol | 60.0 |
| Methanol | 21.0 |
| Dye | 0.2 |
| Viscosity | 20 (cps) |

The aluminum web of the size shown in TABLE 2 is used.

TABLE 2

| | |
|---|---|
| Thickness of web | 200 ($\mu$m) |
| Width of web | 500 (mm) |

TABLE 3 shows the operating conditions of the slide bead coating apparatus.

TABLE 3

| | |
|---|---|
| Web speed | 50 (m/min) |
| Flow rate of coating solutions | 1800 (ml/min) |
| Width of slit | 600 (mm) |
| Shape of rod | Column |
| Material of rod | TEFLON ® |
| Diameter of rod | 7 (mm) |
| Position of rod in direction of width of slide surface | Center of rod corresponds to web edge |
| Distance between rod and lip | 10 (mm) |

The coating solutions were coated on the web along its width under the above-described conditions. The coating solutions which were 60 $\mu$m thick were regularly coated on the surface of the web to the edge region. The coating solutions from the slit which is 600 mm wide were adjusted to be 500 mm wide. That is, the coating solutions which were 600 mm wide and flew down at the front side of the rod were adjusted by a pair of rods so that both edges could be 50 mm wide, and the coating solutions at both edges fell into the pressure reducing chamber.

Example 2

Description will hereunder be given of an example in the second embodiment of the slide bead coating apparatus according to the present invention. In this example, the tube-like nozzle is employed.

The composition and viscosity of the coating solutions and the web were the same as in the Example 1.

TABLE 4 shows the operating conditions in the Example 2.

TABLE 4

| | |
|---|---|
| Web speed | 50 (m/min) |
| Flow rate of coating solutions | 1800 (ml/min) |
| Diameter of nozzle | 3 (mm) |
| Shape of nozzle | Tube-like nozzle |
| Flow speed of discharged liquid | 0.3 (m/sec) |
| Type of discharged liquid | Same type as coating solutions |
| Position of nozzle in direction of width of slide surface | Center of nozzle corresponds to web edge |
| Distance between nozzle and lip | 7 (mm) |

The coating solutions were coated on the entire web along its width under the above-described conditions. The coating solutions which were 60 $\mu$m thick were uniformly coated on the surface of the web to the edge region. The coating solutions extruded from the slit, which was 600 mm wide, were adjusted to be 500 mm wide by forming the edge bead 114A through the nozzle. That is, the coating solutions, which were 600 mm wide and flew down at the front side of the nozzle, were adjusted by the nozzle so that both edges could be 50 mm wide, and the coating solutions at both edges fell into the suction chamber.

As set forth hereinabove, according to the slide bead coating method and apparatus of the present invention, the rod is inserted into the liquid coating composition flowing down the slide surface, thereby forming the flow of edge bead at both side edges of the liquid coating composition. Thus, the liquid coating composition can be coated on the entire web to the edge region.

Moreover, the width of the liquid coating composition can be adjusted only by inserting the rod into the coating solutions. The width of the liquid coating composition is adjusted without stopping the coating operation.

For the reasons stated above, according to the slide bead coating method and apparatus of the present invention, there is no necessity to cut the edge region in the after process unlike the conventional slide bead coating method and apparatus using the guide plate. Thus, there is no need to add the process of cutting the edge region, and the yield can be improved.

Moreover, according to the slide bead coating method and apparatus, there is no need to stop the coating operation so as to adjust the width of the liquid coating composition, and thus the working efficiency can be remarkably improved.

Furthermore, according to the slide bead coating method and apparatus of the present invention, the liquid coating composition or a component of the liquid coating composition is applied on or injected into the liquid coating composition flowing down the slide surface, so that the flow of edge bead can be formed at both side edges of the liquid coating composition. Thus, the liquid coating composition can be coated on the entire web to the edge region.

In the above-mentioned case, the width of the liquid coating composition is adjusted without stopping the coating operation, and therefore the working efficiency can be remarkably improved.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A slide bead coating method for coating a web with a liquid coating composition using a slide hopper having a slide surface such that the liquid coating composition flows down said slide surface to form a bead between a lip of the slide surface and the web, and in which the liquid coating composition flowing down the slide surface is applied to a surface of the web by the bead, comprising the step of:

depositing at least a component of the liquid coating composition on the liquid coating composition flowing down the slide surface of the coating hopper so as to form an edge bead which rises over the liquid surface of the liquid coating composition flowing down, and so as to define a width of the bead which is applied to the web.

2. The slide bead coating method according to claim 1, wherein said step of depositing said component of the liquid coating composition on the liquid coating composition flowing down the slide surface of the coating hopper is performed at a widthwise position near at least one side edge of the liquid coating composition flowing down the slide surface of the coating hopper so as to form the edge bead at the widthwise position.

3. The slide bead coating method according to claim 1, wherein said step of depositing said component of the liquid coating composition on the liquid coating composition flowing down the slide surface of the coating hopper is performed at a widthwise position at at least one side edge of the liquid coating composition flowing down the slide surface of the coating hopper so as to form the edge bead which rises over the liquid surface of the liquid coating composition flowing down at the widthwise position.

4. A slide bead coating apparatus for coating a web with a liquid coating composition comprised of a slide hopper having a slide surface such that the liquid coating composition flowing down said slide surface forms a bead between a lip of said slide surface and a web, and in which said liquid coating composition is applied to the surface of the web by the bead, an improvement in said slide bead coating apparatus comprising:

application means provided at a position upstream of a gap between said lip of said slide surface and said web, said application means for applying at least a component of said liquid coating composition on a liquid surface of said liquid composition flowing down the slide surface of the coating hopper so as to define a width of said bead which is applied to the web; and wherein a position where said application means applies said component of said liquid composition is changeable in a widthwise direction of said liquid composition flowing down the slide surface of the coating hopper so that the defined width of said bead is changeable in accordance with the position where said application means applies said component of said liquid composition.

5. The slide bead coating apparatus according to claim 4, wherein the position where said application means applies said component of said liquid composition is changeable in the widthwise direction from a position at at least one side edge of the liquid coating composition flowing down said slide surface to a position interior to the at least one side edge.

6. The slide bead coating apparatus according to claim 4, wherein the width of said bead defined by said application means is smaller than a width of the liquid coating composition flowing down said slide surface.

7. A slide bead coating apparatus for coating a web with a liquid coating composition, comprised of a slide hopper having a slide surface such that the liquid coating composition flowing down said slide surface forms a bead between a lip of said slide surface and a web, and in which said liquid coating composition is applied to the surface of the web by the bead, an improvement in said slide bead coating apparatus comprising:

an applicator provided at a position upstream of a gap between said lip of said slide surface and said web, said applicator applies at least a component of said liquid coating composition on a liquid surface of said liquid composition flowing down the slide surface of the coating hopper so as to define a width of said bead which is applied to the web; and wherein a position where said applicator applies said component of said liquid composition is changeable in a widthwise direction of said liquid composition flowing down the slide surface of the coating hopper so that the defined width of said bead is changeable in accordance with the position where said applicator applies said component of said liquid composition.

8. The slide bead coating apparatus according to claim 7, wherein the position where said applicator applies said component of said liquid composition is changeable from a position at at least one side edge of said the liquid coating composition flowing down said slide surface to a position interior to the at least one side edge.

9. The slide bead coating apparatus according to claim 7, wherein the width of said bead defined by said applicator is smaller than a width of the liquid coating composition flowing down said slide surface.

* * * * *